United States Patent [19]

Berti et al.

[11] Patent Number: 4,973,282

[45] Date of Patent: Nov. 27, 1990

[54] METHOD FOR MAKING CATHODES FOR NEON AND ARGON GAS FILLED TUBES

[76] Inventors: Walter Berti; Elena Berti, both of Via Sant'Adele, 47 -- 20094 Corsico, Milano, Italy

[21] Appl. No.: 471,842

[22] Filed: Jan. 29, 1990

[51] Int. Cl.[5] ..... H01J 9/18

[52] U.S. Cl. ..... 445/29; 313/288; 313/289; 313/618

[58] Field of Search ..... 445/29, 35, 36; 313/618, 632, 284, 288, 289

[56] References Cited

U.S. PATENT DOCUMENTS

| | | | |
|---|---|---|---|
| 2,030,435 | 2/1936 | Fehse et al. | 313/288 |
| 2,491,425 | 12/1949 | Stutsman | 313/288 |
| 2,677,071 | 4/1954 | Carne | 313/632 |

*Primary Examiner*—Kenneth J. Ramsey

*Attorney, Agent, or Firm*—Bucknam and Archer

[57] ABSTRACT

A method for making gaseous discharge lamp cathodes comprises, in order to perfectly center the cathode with respect to the tube glass envelope, the steps of: (a) narrowing the end portion of the metal cathode near the edge thereof, (b) fully inserting, about the narrowed zone, a circular crown shaped mica small collar and (c) upsetting the edge so as to lock the mica collar in place.

2 Claims, 1 Drawing Sheet

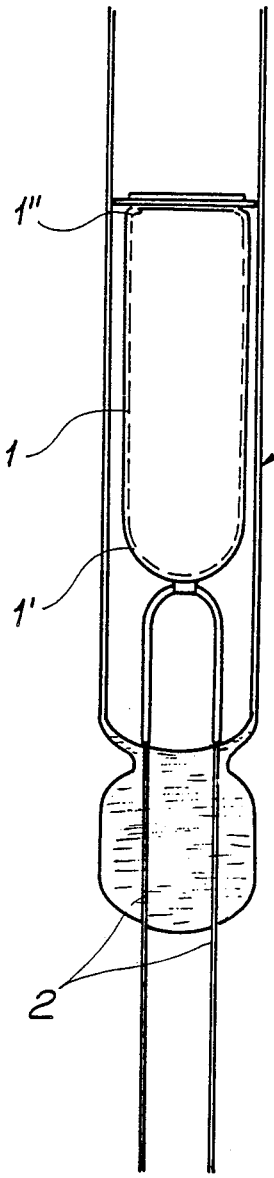
Fig. 1
Fig. 2
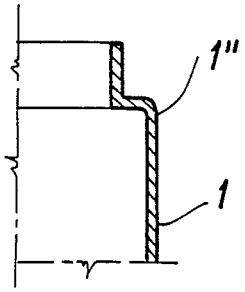
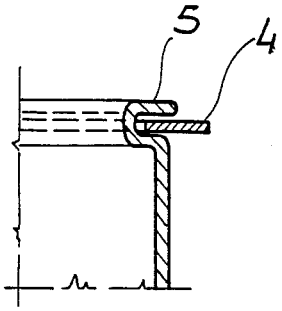
Fig. 3

METHOD FOR MAKING CATHODES FOR NEON AND ARGON GAS FILLED TUBES

BACKGROUND OF THE INVENTION

The present invention relates to a method for making a new type of cathode, for gaseous discharge lamps, such as neon or argon gas filled lamps.

As is known, several problems are involved in making gaseous discharge lamps, mainly because of a quick increase of the lamp temperature which in turn causes a great thermal expansion of the metal cathode and the glass envelope which is susceptible to the easily broken.

In order to at least alleviate the above mentioned problem, the cathode must be precisely fitted in the tube glass envelope so as to be perfectly centered and insulated.

At present this problem is frequently solved by a method which comprises the steps of: (a) engaging a mica spacer collar, of circular crown shape, on the end edge of the metal cathode, (b) locking this mica collar against the end of the cathode by using a longitudinally perforated steatite plug member and (c) wrapping a mica sheet about the cathode so as to insulate the cathode from the envelope glass.

This known method, however, is very complex and expensive.

SUMMARY OF THE INVENTION

Thus, the main object of the present invention is to solve the above mentioned problem in a very simple way, by providing a very simple method for making cathodes for gaseous discharge lamps, in particular neon and argon gas filled lamps, which affords the possibility of perfectly insulating and centering the cathode in such a lamp.

Another object of the present invention is to provide such a gaseous discharge lamp cathode making method which provides a new type of strong, long duration and unexpensive cathode.

According to one aspect of the present invention, the above mentioned objects, as well as yet other objects, which will become more apparent hereinafter, are achieved by a method for making cathodes for gaseous discharge lamps having the features recited in the accompanying claims.

BRIEF DESCRIPTION OF THE DRAWINGS

Further characteristics and advantages of the present invention will become more apparent hereinafter from the following detailed description of a preferred embodiment thereof which is illustrated, by way of an indicative but not limitative examples, in the accompanying drawings, where:

FIG. 1 is a schematic view illustrating a cathode fitted at the end of a glass tube, for gaseous discharge lamps;

FIG. 2 shows the end portion of the cathode, which has been properly narrowed; and FIG. 3 shows the end portion of the cathode with applied a spacer mica collar which is locked in place by upsetting the edge of the cathode.

DESCRIPTION OF THE PREFERRED EMBODIMENT

With reference to the figures of the accompanying drawings, the cathode according to the present invention comprises a cylindrical body 1 which, at one end thereof, is provided with a half-ball shaped portion 1' in which there are fitted the power supply wires 2, the other end 1'' being open and adapted to be fitted in the glass tube 3.

The end portion of the cathode, at the open end 1'', is subjected, according to the invention, to the following processing steps: (a) narrowing the cathode zone near its edge; (b) fitting a spacer collar 4, made of mica and having a circular crown shape, about the narrowed zone; and (c) upsetting the cathode edge 5 so as to lock the mica collar 4 in place.

While the invention has been disclosed and illustrated with reference to a preferred embodiment thereof, it should be apparent that the disclosed embodiment is susceptible to several modifications and variations all of which will come within the spirit and scope of the appended claims.

We claim:

1. A method for making a metal cathode for gaseous discharge lamps, in particular neon and argon gas filled lamps, characterized in that said method comprises the steps of:

(a) narrowing a zone of said cathode near an edge thereof;

(b) fitting, about said narrowed zone, a mica collar of circular crown shape;

(c) upsetting said edge so as to lock said mica collar in place.

2. A metal cathode made by a method according to claim 1, characterized in that said cathode comprises a circular crown shaped mica spacer collar fitted about a narrowed zone of said cathode and locked in place by an upset portion.

* * * * *